United States Patent [19]

Musselman

[11] Patent Number: 4,671,778

[45] Date of Patent: Jun. 9, 1987

[54] IMAGING DEVICE HAVING AN IMPROVED PHOTOEMISSIVE CATHODE APPENDAGE PROCESSING ASSEMBLY

[75] Inventor: Elvin M. Musselman, Paradise Township, Lancaster County, Pa.

[73] Assignee: RCA Corporation, Princeton, N.J.

[21] Appl. No.: 841,229

[22] Filed: Mar. 19, 1986

[51] Int. Cl.[4] ..... H01J 9/233

[52] U.S. Cl. ..... 445/73; 445/14; 445/58

[58] Field of Search ..... 445/14, 22, 36, 40, 445/58, 73

[56] References Cited

U.S. PATENT DOCUMENTS

| | | | |
|---|---|---|---|
| 2,244,720 | 6/1941 | Massa et al. | 250/165 |
| 2,733,115 | 1/1956 | Vine | 445/73 |
| 2,744,808 | 5/1956 | Ruedy | 316/30 |
| 2,752,519 | 6/1956 | Ruedy | 313/65 |
| 2,967,962 | 1/1961 | Turk | 313/65 |
| 3,023,131 | 2/1962 | Cassman | 117/210 |
| 3,037,833 | 6/1962 | Balkwill | 445/58 |
| 3,535,011 | 10/1970 | Matheson et al. | 316/6 |
| 3,658,400 | 4/1972 | Helvy | 313/94 |
| 3,761,762 | 9/1973 | Henry et al. | 315/10 |
| 4,198,106 | 4/1980 | Stowe et al. | 316/4 |
| 4,396,853 | 8/1983 | Caraher | 313/527 |
| 4,593,375 | 6/1986 | Kinoshita | 445/14 |

*Primary Examiner*—Nicholas P. Godici
*Assistant Examiner*—K. Rowan
*Attorney, Agent, or Firm*—Eugene M. Whitacre; Dennis H. Irlbeck; Vincent J. Coughlin, Jr.

[57] ABSTRACT

An imaging device such as a silicon intensifier tube (SIT) has an envelope closed at one end by an input faceplate and at the other end by a camera section which includes a silicon target. A novel appendage processing assembly is in communication with the envelope for forming a photoemissive cathode on an interior surface of the input faceplate. The novel appendage processing assembly includes a conductive tubular sidearm which is attached to the envelope. A chamber is attached at one end of the sidearm. The chamber is closed at the other end by a stem portion having a plurality of conductive stem leads extending therethrough. A contact spring and a connecting rod are provided within the chamber to electrically connect the sidearm to one of the stem leads. At least one alkali metal vapor source and preferably three alkali vapor sources are disposed within the chamber and connected between two of the stem leads to permit electrical resistance heating of the vapor sources. The chamber further includes a U-shaped support rod which has a circular cross-section that is attached at one end to at least one of the stem leads. The closed end of the U-shaped support rod terminates in proximity to the sidearm. A cathode-compatible metal vapor assembly is slidably disposed within the sidearm and chamber. The subassembly includes a source of photoemissive cathode-forming metal, a conductive support rod, a plate member formed of magnetic material, an insulator and a shield. The source of photoemissive cathode-forming metal has a first and a second end. The first end of which is attached to one end of the conductive support rod. The other end of the conductive support rod is attached to the plate member formed of magnetic material. A loop of wire having a circular cross-section is attached to the plate member and slidably communicates with the U-shaped support rod. Since both the wire loop and the U-shaped support rod have a circular cross-section and cross at right angles to one another, the contact area is minimized compared to prior art structures and the sliding friction is reduced, thereby facilitating ingress and egress of at least a portion of the cathode-compatible metal vapor subassembly relative to the envelope. An insulator is disposed around the conductive support rod in proximity to one end thereof and a shield member extends between the second end of the source of photoemissive cathode-forming metal and the insulator. The shield includes a limiting aperture for restricting the deposition of metal from the cathode-forming metal source to the interior surface of the input faceplate.

7 Claims, 2 Drawing Figures

IMAGING DEVICE HAVING AN IMPROVED PHOTOEMISSIVE CATHODE APPENDAGE PROCESSING ASSEMBLY

BACKGROUND OF THE INVENTION

The present invention relates to an improved appendage processing assembly for making photoemissive cathodes in imaging devices such as silicon intensifier tubes, intensified charge-coupled image sensors, image intensifier tubes and photomultiplier tubes.

U.S. Pat. No. 2,744,808, issued to Ruedy on May 8, 1956, discloses an apparatus for use in evaporating chemical materials, specifically the constituents of a photoemissive cathode, including antimony and one or more alkali metals onto a faceplate within an evacuated tube envelope. The apparatus utilizes a unidirectional antimony source and an alkali chamber having a small opening near one end. The structure is complex and expensive to manufacture. Furthermore, while the antimony source is disclosed to be unidirectional, no structure is disclosed for restricting the deposition of antimony to only the faceplate of the tube envelope.

U.S. Pat. No. 3,535,011, issued to Matheson et al. on Oct. 20, 1970, discloses a photomultiplier tube which utilizes two chambers for making the photoemissive cathode. Alkali materials are provided in one chamber, and antimony is slidably disposed in a second chamber. No structure is disclosed for restricting the direction of the antimony evaporation or for centering the antimony source within the tube envelope during the antimony evaporation step. The two chamber structure also is unnecessarily complex and expensive.

U.S. Pat. No. 4,396,853, issued to Caraher on Aug. 2, 1983, discloses an evaporator housing which contains an antimony boat. The boat is mounted on a pair of coaxial rods which are attached to a transversely disposed plate having apertures therein for sliding on a second pair of rails which extend along the evaporator housing. No structure is disclosed to prevent the deposition of antimony on portions of the tube not associated with the photoemissive cathode. Additionally, the alkali generators are located within the tube where they can create particles. The slider structure also has another problem in that it is difficult to overcome the friction associated with the apertured plate sliding on a pair of rods.

A need therefore exists for a single appendage that contains both the antimony and the alkali materials in a single, reliable structure that is easy to assemble, has minimun sliding friction and which properly positions the antimony evaporator within the envelope and limits the antimony deposition only to the photocathode surface.

SUMMARY OF THE INVENTION

An imaging device has an envelope closed at one end by an input faceplate. A novel appendage processing assembly is in communication with the envelope for forming a photoemissive cathode on an interior surface of the input faceplate. The novel appendage processing assembly includes a conductive tubular sidearm which is attached to the envelope. A chamber is attached to the other end of the sidearm. At least one alkali metal vapor source is disposed within the chamber. The chamber further includes conductive support means. A cathode-compatible metal evaporator subassembly is slidably disposed within the sidearm and the chamber.

The subassembly includes a source of photoemissive cathode-forming metal, a conductive support rod, a member formed of magnetic material, and a shield. The source of photoemissive cathode-forming metal is attached to the conductive rod. The conductive rod also is attached to the member formed of magnetic material which includes minimum contact area means that slidably communicates with the conductive support means to facilitate ingress and egress of at least a portion of the subassembly relative to the envelope. The shield includes means for restricting the deposition of metal from the cathode-forming metal source to the interior surface of the input faceplate.

DETAILED DESCRIPTION OF THE PREFERRED EMBODIMENT

Figure 1:
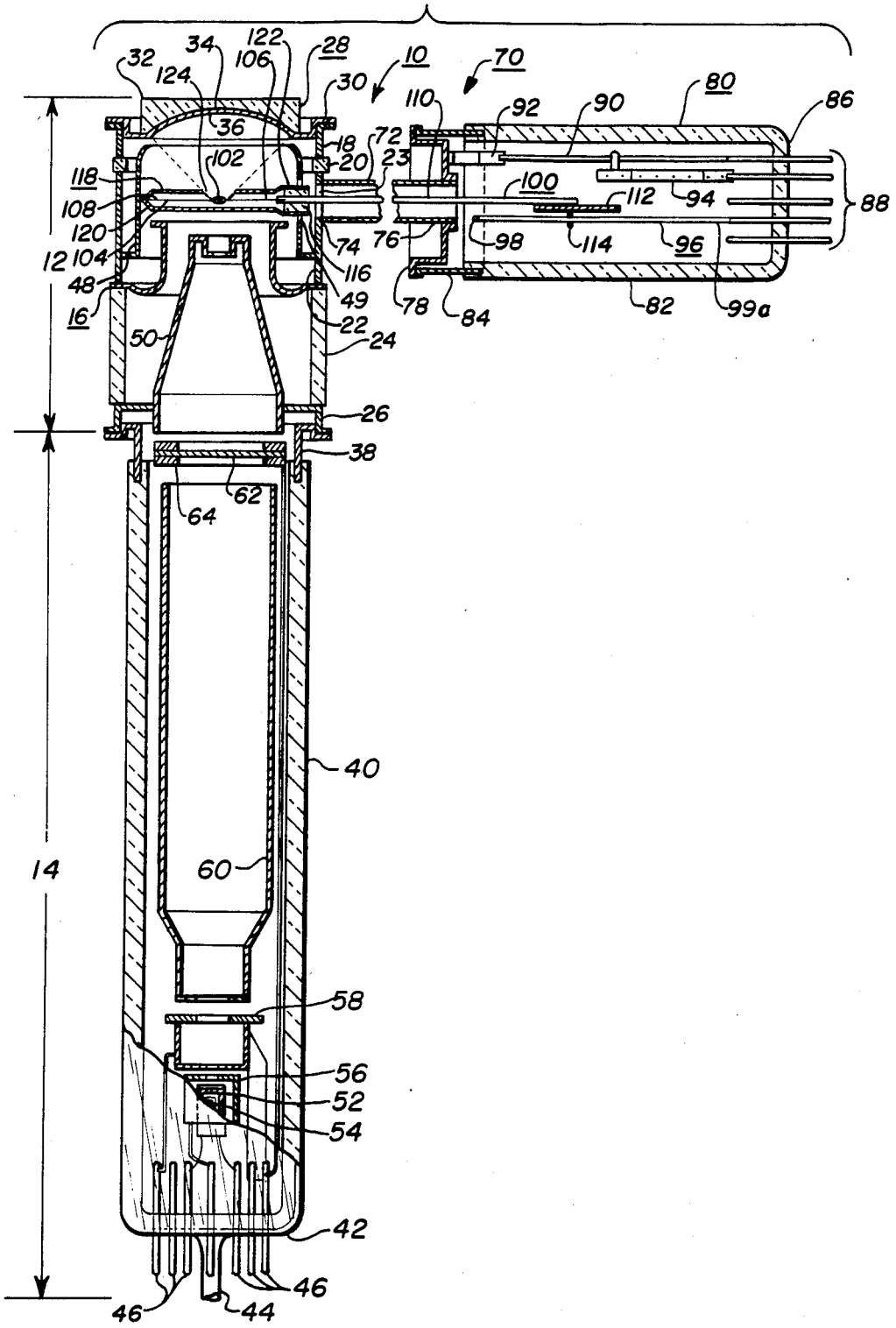
FIG. 1 is a longitudinal section view of an imaging device and novel appendage processing assembly.
Figure 2:
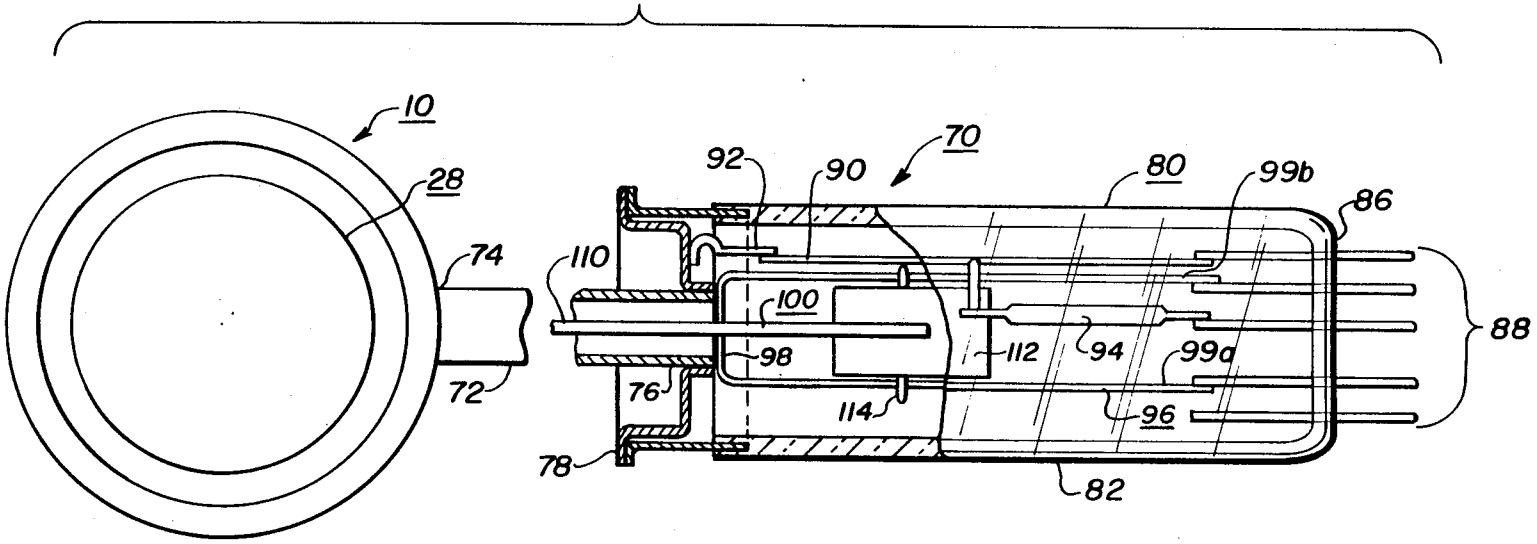
FIG. 2 is a top view, partially in section, of the tube and novel appendage processing assembly.

As shown in FIG. 1, an imaging device, such as a silicon intensifier tube (SIT) 10, includes an image section 12 and a camera section 14. The SIT 10 comprises a substantially cylindrical vacuum envelope 16 which may be of glass-to-metal, or ceramic-to-metal construction. For maintaining close dimensional tolerances, ceramic-to-metal construction is preferred, at least for the image section 12. The vacuum envelope 16 includes an annular envelope input flange 18, at one end, which is attached, for example, by brazing, to one surface of a first insulating spacer 20. A grid bulb flange 22, having an aperture 23 formed through the sidewall, is similarly attached, at its upper end, to the other end of the first insulating spacer 20. A second insulating spacer 24 is attached, also by brazing, between the lower end of the grid bulb flange 22 and an annular envelope output flange 26. An input faceplate assembly 28 closes one end of the image section 12. The input faceplate assembly 28 comprises a cathode faceplate flange 30 and a cathode faceplate 32 having an interior surface 34. The cathode faceplate 32 preferably comprises a fiber optic member, as is known in the art, that is frit sealed, by conventional means, to the cathode faceplate flange 30. The cathode faceplate flange 30 and the envelope input flange 18 are heliarc welded about the periphery to close the input end of the vacuum envelope 16. A photoemissive cathode 36, as described hereinafter, is formed on the interior surface 34 of the faceplate 32 and emits photoelectrons (not shown) in response to radiation incident thereon.

The camera section 14 of the vacuum envelope 16 comprises an annular camera flange 38 which is attached to one end of a tubular glass member 40. An envelope stem portion 42 closes one end of the tubular glass member 40. An exhaust tubulation 44, extends through the envelope stem portion 42 and provides means for exhausting the vacuum envelope 16. A plurality of conductive leads 46 extend through the stem portion 42 and provide means for contacting the internal elements of the camera section 14.

Within the image section 12 is a control grid 48, having a sidewall aperture 49 therethrough, and an anode cone 50. The sidewall aperture 49 is aligned with the aperture 23 in the grid bulb flange 22. Within the camera section 14 is a thermionic cathode 52, a filament heater 54 disposed within the cathode 52, a control electrode 56, an accelerating electrode 58, a tubular focusing electrode 60 and a silicon target 62, comprising output means, secured to a target support electrode 64 and spaced from the photoemissive cathode 36 for receiving photoelectrons therefrom. The thermionic cathode 52, the heater 54 and the electrodes 56, 58 and 60 comprise electron beam generating and focusing means. An external coil, not shown, provides means for scanning the silicon target 62 with an electron beam, as is known in the art. The SIT 10, as described herein, is conventional and is commercially available as the 4804 series manufactured by RCA, Lancaster, PA.

A novel appendage processing assembly 70 is in communication with the vacuum envelope 16 and is used to form the photoemissive cathode 36. The appendage processing assembly 70 includes a conductive tubular sidearm 72 having a proximal end 74 and a distal end 76. The tubular sidearm 72 is preferably formed of copper. The proximal end 74 of the tubular sidearm 72 is attached to the envelope 16 by brazing to the sidewall of the grid bulb flange 22 which circumscribes the sidewall aperture 23. A transition flange 78 is brazed to the distal end 76 of the tubular sidearm 72. A chamber 80 is attached at one end to the tubular sidearm 72. The chamber 80 comprises a tubular glass envelope portion 82 having a mating flange 84 at one end and a stem portion 86 which closes the other end of the chamber 80. A plurality of conductive stem leads 88 extends through the stem portion 86. The mating flange 84 is attached, for example, by heliarc welding, to the transition flange 78.

Biasing means comprising a connecting rod 90 and a contact spring 92 extend between one of the stem leads 88 and the transition flange 78 to electrically connect the tubular sidearm 72 to the one stem lead 88. The spring 92 mechanically contacts the surface of the transition flange 78. This electrical connection can be utilized as a common electrical connection during the processing of the photoemissive cathode 36 to be described hereinafter. At least one alkali metal vapor source 94 and preferably three separate sources 94, only one of which is shown, are provided within the chamber 80. Each of the alkali metal vapor sources 94 is conventional and comprises a tantalum retainer having a suitable mixture of an alkali metal powder and a reducing agent therein. Each alkali metal vapor source 94 is connected between two of the stem leads 88 to permit electrical resistance heating of the alkali metal vapor source. Preferably one of the stem leads 88 comprises the common electrical connection previously described. If three alkali metal vapor sources 94 are used in processing the photoemissive cathode 36, the alkali metals vapor sources 94 preferably comprise cesium, potassium and sodium. If less than three alkali metal vapor sources 94 are used, the alkali metal or metals are selected to provide the photoemissive cathode 36 with a spectral sensitivity responsive to the wavelength of radiation incident on the cathode faceplate 32, as in known in the art.

A U-shaped support rod 96, having a closed end 98 and a bifurcated open end including a pair of legs 99*a* and 99*b*, is attached by the legs 99*a* and 99*b* to different stem leads 88 so that the closed end 98 terminates in proximity to, but spaced from, the transition flange 78 which is attached to the tubular sidearm 72. The support rod 96 has a circular cross-section and provides a conductive support means for a cathode-compatible metal evaporator subassembly, such as an antimony evaporator subassembly 100.

The antimony evaporator subassembly 100 includes a source of photoemissive cathode-forming metal, such as a platinum-antimony bead 102 which is affixed to a platinum-clad molybdenum wire 104 having a first end 106 and a second end 108. The platinum-antimony bead 102 comprises 50% platinum and 50% antimony, by weight, as is known in the art. Alternatively, a bead of pure antimony may be used. A conductive rod 110 is attached, at one end, to the first end 106 of the wire 104. The other end of the conductive rod 110 is attached to the upper surface of a substantially rectangular plate member 112. The plate member 112 is preferably formed of magnetic material, such as Kovar. A loop 114 of circular cross-section wire is attached to the lower surface of the plate member 112, so that the wire crosses at right angles to, and contacts and encircles both of the legs 99*a* and 99*b* of the U-shaped support rod 96. As herein described, both the U-shaped support rod 96 and the loop 114 have a circular cross-section so that the contact area therebetween, and the resulting sliding frictional forces are minimized. A cylindrical insulator 116 is disposed around the conductive rod 110 in proximity to the end attached to the first end 106 of the wire 104. A hollow tubular shield member 118 is disposed substantially around the wire 104 and the platinum-antimony bead 102. The shield member 118 is partially closed at one end 120, for example, by crimping. Only a small opening (not shown) is provided in the partially closed end 120 to permit a portion of the second end 108 of the wire 104 to pass therethrough. The second end 108 of the wire 104 is electrically connected, for example, by welding, to the shield member 118. The shield member 118 has an oppositely disposed open end 122 which makes an interference fit with the outside surface of the cylindrical insulator 116. A limiting aperture 124 is formed through the sidewall of the shielding member 118 to restrict the path of the antimony to the area within the dashed lines of FIG. 1 and to limit the deposition of antimony from the platinum-antimony bead 102 onto the interior surface 34 of the cathode faceplate 32.

General Considerations

The antimony evaporator subassembly 100 is shown having the platinum-antimony bead 102 and shield member 118 disposed within the image section 12 of the SIT 10 for formation of the photoemissive cathode 36 on the interior surface 34 of the cathode faceplate 32. The length of the tubular sidearm 72 and that of the chamber 80 are selected to allow the antimony evaporator subassembly 100 to be withdrawn completely from within the interior of the image section 12 and to be contained within the sidearm 72 and the chamber 80 during tube bakeout and subsequent to he formation of the photoemissive cathode 36.

Cathode processing and activation requires that the SIT 10, with the novel appendage processing assembly 70 attached thereto, be attached by means of exhaust tubulation 44 to an exhaust system (not shown). The antimony evaporator subassembly 100 is positioned within both the chamber 80 and the tubular sidearm 72 by means of a magnet or solenoid (not shown) which is used to draw the plate member 112, formed of magnetic material, completely across the length of the chamber 80. The minimum contact area afforded by the circular cross-section of the wire loop 114 riding on the circular cross-section of the U-shaped support rods 96 reduces the sliding friction of the antimony evaporator subassembly 100 and facilitates ingress and egress of the forward end of the antimony evaporator subassembly 100, i.e., the end containing the hollow tubular shield member 118 surrounding the platinum-antimony bead 102, relative to the envelope 16. An oven (not shown) is lowered over both the SIT 10 and the appendage processing assembly 70, and they are baked at an elevated temperature, as is known in the art, to remove occluded gases from within the SIT 10 and appendage processing assembly 70. The SIT 10 is allowed to cool to room temperature, and the thermionic cathode 52 is activated by applying voltage to the filament heater 54. Following activation of the thermionic cathode 52, the photoemissive cathode 36 is formed on the interior surface 34 of the cathode faceplate 32. The novel appendage processing assembly 70 facilitates the formation of the photoemissive cathode 36 by locating all the cathode constituents within a single appendage rather than using two appendages, one for the antimony and the other for the alkali metal sources, as in the prior art. This expedient reduces manufacturing cost and increases the vacuum reliability of the finished SIT 10 by eliminating one additional copper tubulation. The present novel structure is also superior to prior art structures in which the alkali metal sources are permanently disposed within the tube. Experience has shown that the internally disposed alkali metal sources may leak powder which is a source of particles within the tube.

In order to process the photoemissive cathode 36, the portion of the antimony evaporator subassembly 100, containing the platinum-antimony bead 102 and the tubular shield member 118, is moved within the image section 12 of the envelope 16 by magnetically drawing the plate member 112 toward the tubular sidearm 72. As shown in FIG. 1, when the antimony evaporator subassembly 100 is in the cathode processing position, the tubular shield member 118 is disposed within the control grid 48 so that its closed end 120 contacts the side of the control grid 48 opposite the grid sidewall aperture 49. This positioning locates the antimony evaporator subassembly 100 so that the platinum-antimony bead 102 is centered with respect to the interior surface 34 of the cathode faceplate 32. The photoemissive cathode 36 is formed by first evaporating a quantity of antimony from the platinum-antimony bead 102. The limiting aperture 124, formed in the side of the tubular shield member 118, restricts the deposition of antimony from the platinum-antimony bead 102 to the interior surface 34 of the cathode faceplate 32. The SIT 10 is again heated by means of the oven (not shown) to a suitable temperature, and the alkali metal vapor sources 94 are electrical resistance heated to provide alkali metal vapors which are driven through the tubular sidearm 72 onto the interior surfaces 34 of the cathode faceplate 32.

The resulting photoemissive cathode 36 comprises potassium-sodium-cesium-antimony. A method of making such a photoemissive cathode is described in U.S. Pat. No. 3,372,967, issued to F. R. Hughes on Mar. 12, 1968, and entitled, "METHOD OF MAKING A MULTI-ALKALI CATHODE", and in U.S. Pat. No. 3,658,400, issued to F. A. Helvy on Apr. 25, 1972, entitled, "METHOD OF MAKING A MULTIALKALI PHOTOCATHODE WITH IMPROVED SENSITIVITY TO INFRARED LIGHT AND A PHOTOCATHODE MADE THEREBY", which are incorporated by reference herein for the purpose of disclosure. Following the formation of the photoemissive cathode 36, the thermionic cathode 52 is reactivated, and then, the getters (not shown) are flashed, as is known in the art. The SIT 10 is removed from the exhaust system (not shown) by tipping-off the glass exhaust tubulation 44. Then, the antimony evaporator subassembly 100 is fully withdrawn from the image section 12 of the envelope 16, and the copper tubular sidearm 72 is pinched-off to remove the novel appendage processing assembly 70. The pinch-off (not shown) of the sidearm 72 provides a cold weld which preserves the vacuum integrity of the SIT 10.

What is claimed is:

1. In an imaging device having an envelope closed at one end by an input faceplate and having output means at the other end, means for evacuating said envelope, an appendage processing assembly in communication with said envelope, and a photoemissive cathode formed on an interior surface of said input faceplate, the improvement wherein said appendage processing assembly comprises a conductive tubular sidearm attached to said envelope, a chamber attached at one end to said tubular sidearm and closed at the other end of a stem portion having a plurality of conductive stem leads extending therethrough, biasing means, within said chamber for electrically connecting said tubular sidearm to one of said stem leads, at least one alkali metal vapor source within said chamber, said alkali metal vapor source being connected between two of said stem leads to permit electrical resistance heating of said alkali metal vapor source, conductive support means within said chamber, said support means being attached at one end to at least one of said stem leads, the other end of said support means terminating in proximity to said tubular sidearm, and a cathode-compatible metal evaporator subassembly slidably disposed within said tubular sidearm and said chamber, said metal evaporator subassembly including a source of photoemissive cathode-forming metal having a first and a second end, a conductive rod attached at one end to said first end of said source of photoemissive cathode-forming metal and at the other end to a member formed of magnetic material, said member having minimum contact area means which slidably communicates with said conductive support means to facilitate ingress and egress of at least a portion of said evaporator subassembly relative to said envelope, an insulator disposed around said conductive rod in proximity to said one end thereof, and a shield extending between the second end of said source of photoemissive cathode-forming metal and said insulator, said shield including means for restricting the deposition of metal from said photoemissive cathode-forming metal source to said interior surface of said input faceplate.

2. The imaging device as described in claim 1, wherein said chamber comprises an insulative cylinder.

3. The imaging device as described in claim 1, wherein said source of photoemissive cathode-forming metal comprises a bead of platinum-antimony affixed to a wire.

4. The imaging device as described in claim 3, wherein said shield comprises a hollow tubular member partially closed at one end and open at the other end, said open end being disposed around said insulator and said partially closed end having said second end of the wire to which said bead of platinum-antimony is affixed extending therethrough and in electrical contact therewith, said hollow tubular member having a limiting aperture formed through the sidewall thereof to restrict the path of the antimony evaporated from said platinum-antimony source and to limit deposition of antimony to said interior surface of said input faceplate.

5. The imaging device as described in claim 1, wherein said minimum contact area means comprises a loop of wire having a circular cross-section.

6. In a silicon intensifier tube having an image section and a camera section within a vacuum envelope, said image section including an input faceplate having an interior surface, and an alkali-antimonide photoemissive cathode formed on said interior surface of said input faceplate by an appendage processing assembly, said photoemissive cathode providing photoelectrons in response to radiation incident thereon, said camera section including a silicon target spaced from said photoemissive cathode for receiving photoelectrons from said photoemissive cathode, beam generating and focusing means for providing an electron beam which scans said target, and an exhaust tubulation for removing gases from within the vacuum envelope, the improvement wherein said appendage processing assembly comprises a conductive tubular sidearm extending from said image section, a chamber attached at one end to said tubular sidearm and closed at the other end by a stem portion having a plurality of conductive stem leads extending therethrough, biasing means within said chamber for electrically connecting said tubular sidearm to one of said stem leads, at least one alkali metal vapor source within said chamber, said alkali metal vapor source being connected between two of said stem leads to permit electrical resistance heating of said alkali metal vapor source, conductive support means within said chamber, said support means comprising a U-shaped support rod having a circular cross-section, said support rod being attached at one end to at least one of said stem leads, the other end of said support rod terminating in proximity to said tubular sidearm, and, an antimony evaporator subassembly slidably disposed within said tubular sidearm and said chamber, said antimony evaporator subassembly including a platinum-antimony bead affixed to a wire having a first and a second end, a conductive rod attached at one end to said first end of said wire and at the other end to a plate member formed of magnetic material which includes minimum contact area means which slidably communicates with said conductive support means to facilitate ingress and egress of at least a portion of said antimony evaporator subassembly relative to said envelope, an insulator disposed around said conductive rod in proximity to said one end thereof, and a hollow tubular shield member disposed substantially around said platinum-antimony bead, said shield member being partially closed at one end and open at the other end, said open end being disposed around said insulator, said second end of said wire to which said platinum-antimony bead is affixed extending through said partially closed end of said shield and making electrical contact therewith, said shield having a limiting aperture formed through the sidewall thereof to restrict the deposition of antimony from said platinum-antimony bead to said interior surface of said input faceplate.

7. The silicon intensifier tube as described in claim 6, wherein said minimum contact area means comprises a loop of wire having a circular cross-section which is attached to said plate member and which contacts and encircles said U-shaped support rods which also has a circular cross-section so that the contact area therebetween is minimal.

* * * * *